US006634717B2

(12) United States Patent
Kown

(10) Patent No.: US 6,634,717 B2
(45) Date of Patent: Oct. 21, 2003

(54) TILTING CHAIR

(75) Inventor: Dong-Yul Kown, Seoul (KR)

(73) Assignee: Fursys Incorporation, Seoul (KR)

( * ) Notice: Subject to any disclaimer, the term of this patent is extended or adjusted under 35 U.S.C. 154(b) by 0 days.

(21) Appl. No.: 09/987,591

(22) Filed: Nov. 15, 2001

(65) Prior Publication Data

US 2003/0090139 A1 May 15, 2003

(51) Int. Cl.[7] ..... A47C 1/12

(52) U.S. Cl. ..... 297/446.2; 297/447.2; 297/452.14; 297/294; 297/160; 297/170

(58) Field of Search ..... 297/447.2, 446.2, 297/447.4, 448.2, 160, 170, 171, 452.14, 452.15, 288, 286, 294

(56) References Cited

U.S. PATENT DOCUMENTS 3,404,916 A * 10/1968 Rowland ..... 297/239
3,628,832 A * 12/1971 Jennings ..... 297/451.1
3,734,561 A * 5/1973 Barecki et al. ..... 297/239
4,892,355 A * 1/1990 Fend ..... 297/440.22
5,064,247 A * 11/1991 Clark et al. ..... 297/447.3
5,123,702 A * 6/1992 Caruso ..... 297/440.21
5,697,673 A * 12/1997 Favaretto ..... 297/301.1
5,868,468 A * 2/1999 Wang ..... 297/320
5,924,770 A * 7/1999 Tarnay et al. ..... 297/440.15
D464,208 S * 10/2002 Kwon ..... D6/373

* cited by examiner

*Primary Examiner*—Peter M. Cuomo
*Assistant Examiner*—Sarah C. Burnham
(74) *Attorney, Agent, or Firm*—Antonelli, Terry, Stout & Kraus, LLP

(57) ABSTRACT

A tilting chair comprising: a support board integrating a seat and back support to be elastically transformable backwards when a user places pressure onto the back support; a frame having a back support part, horizontally coupled at an external surface of the back support, a pair of rear legs extending from both left and right sides of the back supporting part downwards the floor, a pair of feet bent at ends of the rear legs and extending forwardly along the floor surface, a pair of front legs extending upwardly from the front ends of the feet, a front side seat support part bent and extending at both upper ends of the front legs to support the front portion of the seat, and a rear side seat support part connecting a center portion of the rear legs to support the rear portion of the seat; and flanges and coupling units respectively assembled at an external surface of the back support part and the lower surface of the seat to make a user feel comfortable because the back support is smoothly tilted backwards when the chair is tilted to easily control tilting force and range depending upon the user and to maintain it's a tilted angle with even a small degree of effort.

10 Claims, 13 Drawing Sheets

TILTING CHAIR

BACKGROUND OF THE INVENTION

1. Field of the Invention

The present invention relates to a chair, and more particularly to a tilting, public chair.

2. Brief Description of the Prior Art

In general, an office chair has multiple uses as an individual office chair mostly used at personal business offices or study rooms and a public chair used at a large-scale space like a conference or lecture room.

The individual office chair has a tilting function to reduce a user's fatigue from long hours of work by having the back tilted backwards when a user leans onto the back of the chair. In order to include the tilting function as such, a chair should be made with a particular tilting structure by the addition of a spring or other resilient materials according to a complicated manufacturing process.

On the other hand, the public office chair a firmly coupled back supporting board and seat anchored to the supporting frame. As a result, it has only a function to provide seating at a low price, but fails to offer any comfort to a user.

Therefore, the conventional public chair has a problem of providing long hours of sitting making the user very tired because the back supporting board is not tilted at all.

Besides, even if the user stretches backwards to relieve physical strain, only the neck part is stretched because of the fixed shape of the back supporting board which reduces the stretching effect without relief of the user's exhaustion.

SUMMARY OF THE INVENTION

It is an object of the present invention to solve the aforementioned problems and provide a tilting chair whose frame can be modified and tilted by letting its back supporting board thereof be tilted backwards, to thereby help a user to effectively stretch backwards and to easily relieve fatigue.

It is another object of the present invention to provide a tilting chair that has a function to easily control its tilting force and range depending upon a user and that can maintain a tilting angle with even a small degree of force.

It is still another object of the present invention to provide a tilting chair having a shelf for holding a user's materials and a writing board which can perform its intended function without affecting the tilting function.

In order to accomplish the aforementioned objects of the present invention, there is provided a tilting chair comprising:

a support board integrating a seat and a back support to be elastically transformable backwards when pressure is applied to the back support;

a frame which comprises a back support part tightly, horizontally coupled at an external surface of the back support, a pair of rear legs bent downwards and extending at both left and right sides of the back support part, a pair of feet bending at ends of the rear legs and extending forwards, a pair of front legs extending upwards from front ends of the feet, a seat front side support part bending and extending at both upper ends of the front legs to support a front portion of the seat, and a rear side seat support part connecting a center portion of the rear legs to support the rear portion of the seat;

flanges longitudinally coupled at the bottom surface of the seat;

a first coupling unit mounted at the front side of the flanges which fixes the front side seat support part; and a second coupling unit mounted at the rear side of the flanges which fixes the seat rear side support part; and wherein the second coupling unit has a head part, a tail part and a connecting protrusion formed at the end of the tail part to allow the rear side seat support part to slide along the tail part within a range between the head part and the connecting protrusion.

The chair further comprises:

a flange unit mounted on the external surface of the back support and formed with a plurality of flanges spaced with a predetermined spacing therebetween;

a pair of bushes fitting with the flange unit and releasably coupled to each other to insert the back support part therebetween; and a third coupling unit having a plurality of projections which fit between the flanges of the flange unit.

Furthermore, the back support of the support board comprises a plurality of long holes formed to make a user easily lift the chair; a concave part formed at a portion where the seat and back support meet and grooved horizontally face each other to allow the back support to transform when pressure is applied to the back support; and the front end of the seat of the support board is formed with a downwardly curved surface to prevent the front end of the seat from pressing into the user's thigh, and pairs of shoes respectively coupled at both sides of the feet with connecting protrusions formed to face each other for easy connection to another chair.

The chair further comprises;

a front horizontal part extending in parallel to the front side seat support part from the center portion of the front legs ; and a shelf whose with a front portion connected to the front horizontal part and a rear portion connected to the rear side seat support part; and wherein the shelf further comprises horizontal racks connected to the front horizontal part and rear connecting racks rotatively coupled with a vertical part at the rear side of the horizontal racks and connected to the rear side seat support part.

Furthermore, a pair of horizontally extending parts extends a length in parallel to the seat at both left and right ends of the back support part; the pair of rear legs are bent toward the floor from an end of the horizontally extended parts; a support rack is coupled at a part where the seat front side support part and the front leg meet and extends upwardly to the height of the horizontally extending part, a board is coupled at the horizontally extending part and the support rack for easy writing; the upper portion of the support rack is coupled with the board by a first fixing bracket; the horizontally extending part is coupled with the board by a second fixing bracket, the first fixing bracket is restricted from relative movement relative to the support rack by a protrusion formed at the support rack when the chair is tilted; and the second fixing bracket is coupled to slide relative to the horizontally extending part when the chair is tilted.

BRIEF DESCRIPTION OF THE DRAWINGS

Objects and aspects of the invention will become apparent from the following description of preferred embodiments with reference to the accompanying drawings in which.

DETAILED DESCRIPTION OF THE INVENTION

Hereinafter, a preferred embodiment of the present invention will be described in detail with reference to accompanying drawings.

Figure 1:
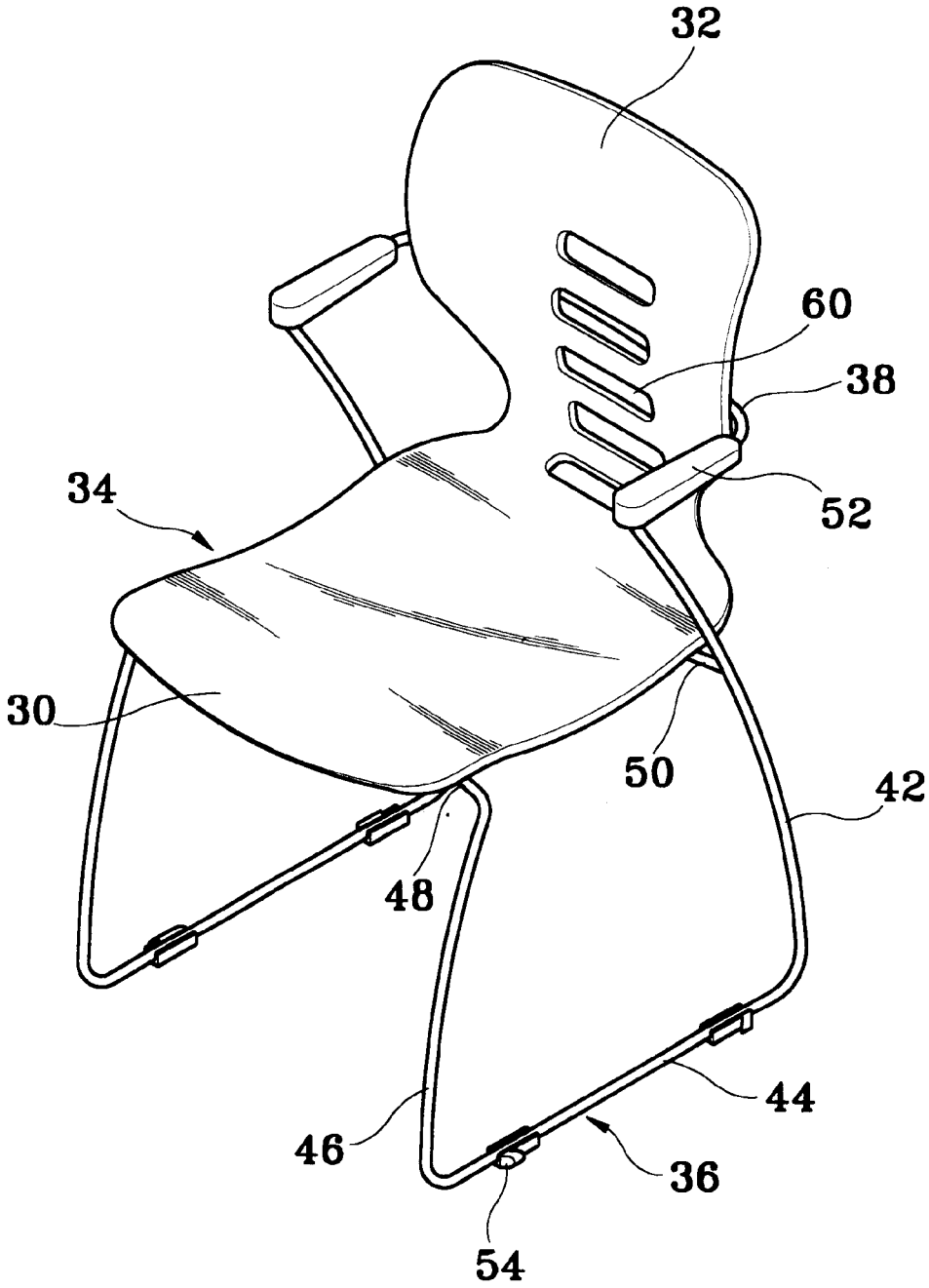
FIG. 1 is a perspective view for illustrating a tilting chair.
Figure 2:
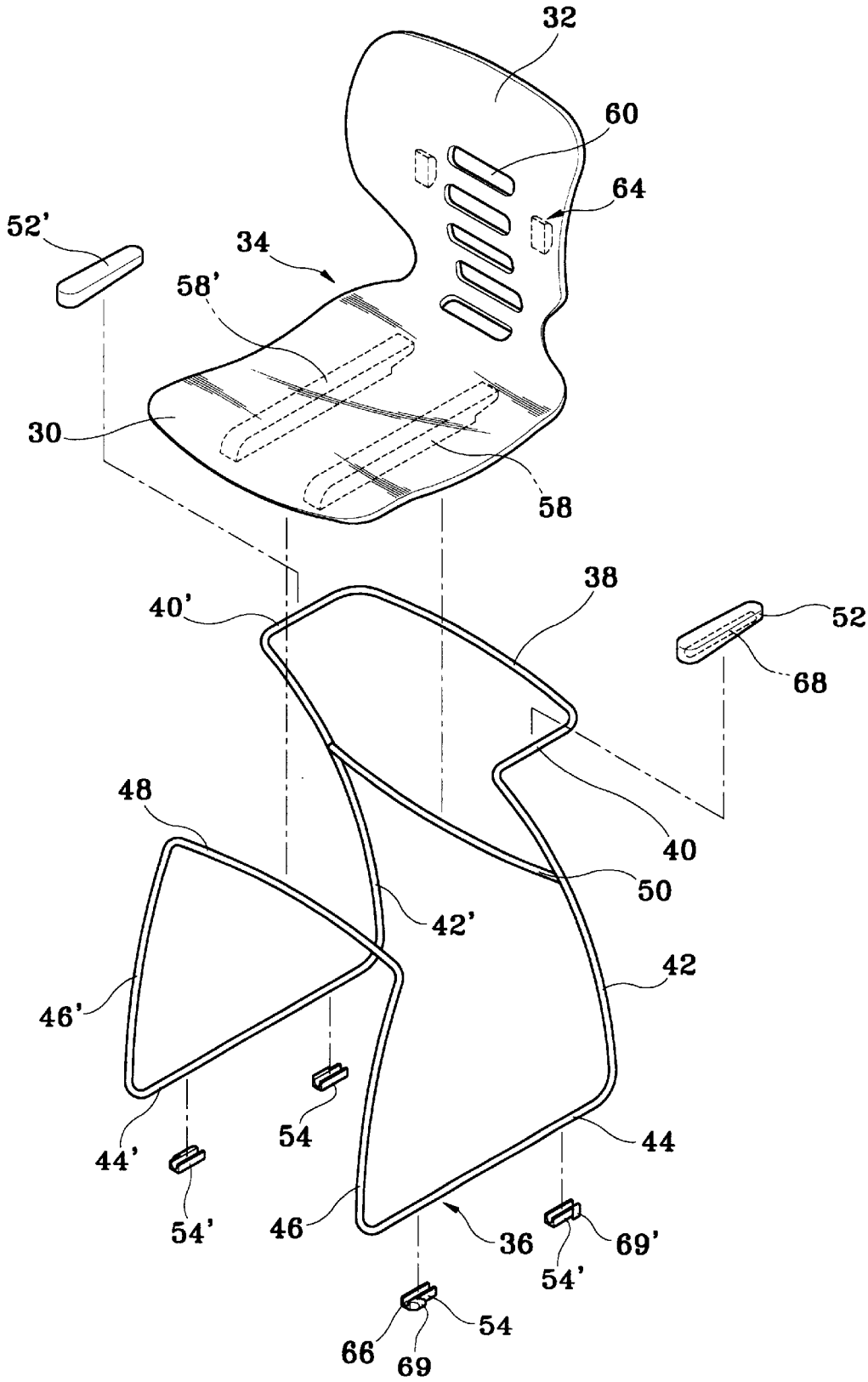
FIG. 2 is an exploded, perspective view of the tilting chair shown in FIG. 1.

FIGS. 1 and 2 are respectively a perspective view and an exploded, perspective view for illustrating a tilting chair in accordance with a first embodiment of the present invention.

As shown in the drawings, the tilting chair of the first embodiment of the present invention is constructed with a back support 32, and a seat 30 integrated with the back support. A support board 34 is elastically transformable backwards when a user puts pressure onto the back support 32. A frame 36 is attached to the back support 32 and the support board 34.

At this time, the frame 36 is made of an elastic metal rod, including: a back support part 38 tightly, horizontally coupled at the external surface of the back support 32; a pair of horizontally extended parts 40 and 40' extending a predetermined length in parallel to the seat 30 at both left and right ends of the back support part 38; a pair of rear legs 42 and 42' bent and extending from the ends of the horizontally extended parts 40 and 40' downwards to the floor surface, a pair of feet 44 and 44' bent at ends of the rear legs 42 and 42' and extending forwards along the floor surface, a pair of front legs 46 and 46' extending upwards from the front ends of the feet 44 and 44', a front side seat support part 48 bent and extending from both upper ends of the front legs 46 and 46' to support the front portion of the seat 30 and a seat rear side support part 50 which connects the center of the rear legs 42 and 42' to support the rear portion of the seat 30.

Arm supports 52 and 52' cover the pair of horizontally extended parts 40 and 40' and shoes 54 and 54' fit both sides of the feet 44 and 44' for easy alignment of chairs without directly touching the floor.

FIG. 2 illustrates an exploded view of the embodiment of FIG. 1.

Figure 3:
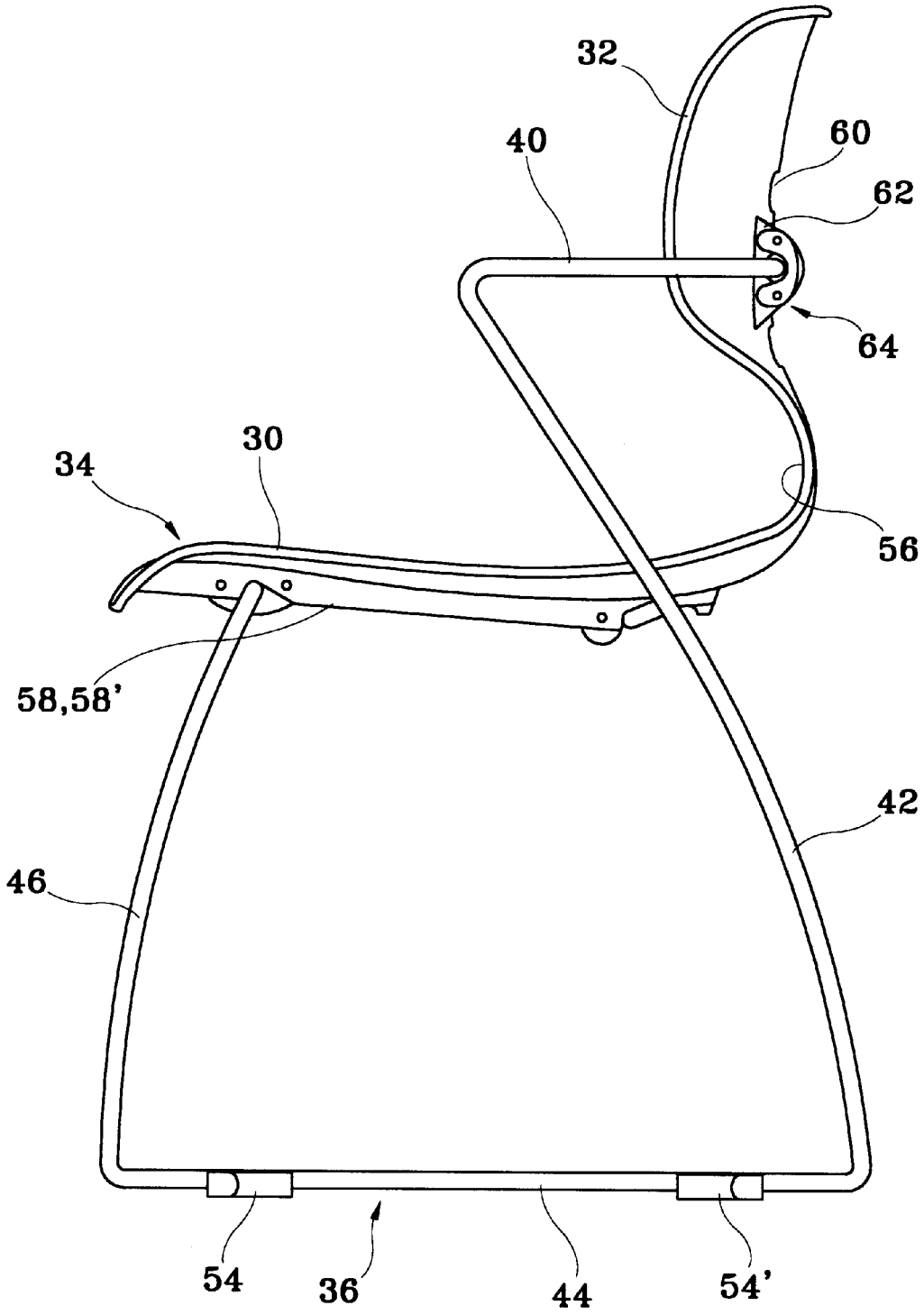
FIG. 3 is an elevation of a tilting chair in accordance with a first embodiment of the present invention.

As shown in FIG. 3, the seat 30 of the support board 34 has a front end with a downwardly curved surface to make a user feel more comfortable when the thigh touches the front end of the seat 30. Furthermore, a concave part 56 is formed at a portion where the seat 30 and the back support 32 meet, as seen from the lateral side of the chair. The concave part 56 is bent rearwardly to be easily deform without causing damage when user puts pressure onto the back support 32 . The concave part 56 makes the back support 32 more flexible to transform the shape of the chair.

In addition, the concave part 56, as shown in FIG. 2, has grooves which horizontally face each other, which allows the back support 32 to easily transform when the user puts pressure onto the back support with the users back.

At this time, the seat 30 and the back support 32 are respectively shaped as a curved surface which is suitable for a user's hip and back.

A pair of flanges 58 and 58' are mounted longitudinally on the bottom surface of the seat 30 and coupled with the seat front side support part 48 and the seat rear side support part 50 of the frame 36. The pair of flanges 58 and 58'are formed at two positions in the horizontal direction of the seat 30. The pair of flanges 58 and 58' are spaced apart by spacing so that first and second coupling units, which are described below, can be put therebetween.

A plurality of horizontally disposed elongated holes 60 are formed in the back support 32 and the concave part 56 at a predetermined spacing along the vertical direction of the back support 32.

Furthermore, two flange units 64 having a plurality of flanges 62 are mounted on the external surface of the back support 32, with a predetermined spacing along the width direction of the back support, and are coupled to back support part 38. The flanges 62 have a spacing along the width so that each projection of a third coupling unit, which is described below, can be fit therebetween.

The back support part 38 of the frame 36 is formed in a shape of a curve, identical to an external shape of the back support 32. If the horizontally extending part 40 of a chair is long, it is difficult to put many chairs together. Therefore, it is preferable that the length of the horizontally extended part 40 is ⅓ of the length of the seat 30.

The front side seat support part 48 and the rear side seat support part 50 are roughly at the same height. At this time, the rear seat side support part 50 is slightly protruding at the rear legs 42 and 42' in a lower, direction and extends in parallel with the seat front side support part 48.

The arm supports 52 and 52' and shoes 54 and 54' are made of a plastic material. Longitudinal groove slots 68 and 66 respectively of the arm supports 52 and 52' and shoes 54 and 54', have a diameter identical to that of the rod frame 36 to fit to the horizontally extending parts 40 and 40' and the feet 44 and 44'. The cross-section of the groove slots 68 and 66 are formed with an arc, slightly larger than a semicircle. Therefore, if the arm supports 52 and 52' and shoes 54 and 54' are pushed with their groove slots 68 and 66 onto the rod of the horizontally extending parts 40 and 40' and feet 44 and 44', the groove slots 68 and 66 of the plastic arm supports 52 and 52' and shoes 54 and 54' are easily widened for easy insertion, but no detachment of plastic material occurs because of elasticity thereof.

At this time, the shoes 54 and 54' are respectively coupled at both sides of the feet 44 and 44', and protrusions 69 and 69' are formed at the lateral sides of the shoes 54 and 54'. The protrusions 69 and 69' which are coupled at both sides of the feet 44 and 44', are formed to face each other, thereby permitting easy attachment of the shoes 54 and 54' to other chairs.

Figure 4:
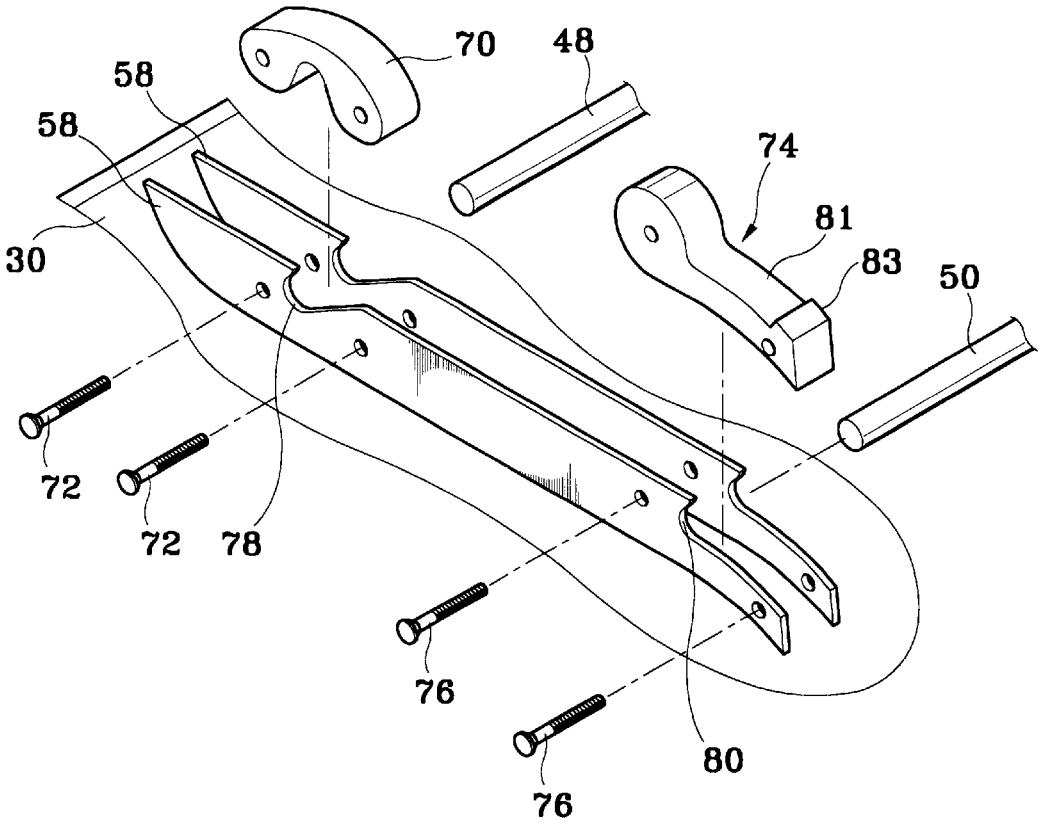
FIG. 4 is a perspective, exploded view illustrating in detail a coupling part of the seat and frame shown in FIG. 1.

FIG. 4 is an exploded, perspective view illustrating a coupling part of the seat and frame as seen from the bottom of the seat.

As shown in FIG. 4, a first coupling unit 70 fits between the front sides of flanges 58 and 58' at the lower side of the seat 30 for coupling the front side seat support part 48 with fastening members 72. Furthermore, a second coupling unit 74 fits between the rear sides of flanges 58 and 58' for coupling the rear side seat support part 50 with fastening members 76.

A pair of grooves 78 having a straight inclined rear side and a front side formed as a circular arc, are formed at the front side of the flanges 58 and 58' for the front side seat support part 48 to be easily accommodated and connected. A connecting part 80 is formed at the rear portion of the flanges 58 and 58' of the rear support seat part 50 to be supported without being pushed forwards. The rear portion of the connecting part 80 has a low part for easy attachment to the rear side seat support part 50.

The first coupling unit 70 has convex portions at the sides thereof and a concave portion at the center thereof. The front side seat support part 48 is inserted into the concave part. The second coupling unit 74 has a tail part 81 extending from its head to the rear side. A connecting protrusion 83 is formed at the end of the tail part 81 to restrict a range that the second coupling unit 74 may slide, so that the rear side seat support part 50 is connected at a part where the head and tail part 81 meet. Thus, if the second coupling unit 74 is coupled, the external surface of the tail part 81 protrudes slightly higher than the rear portion of the connecting part 80 of the frame.

Figure 5:
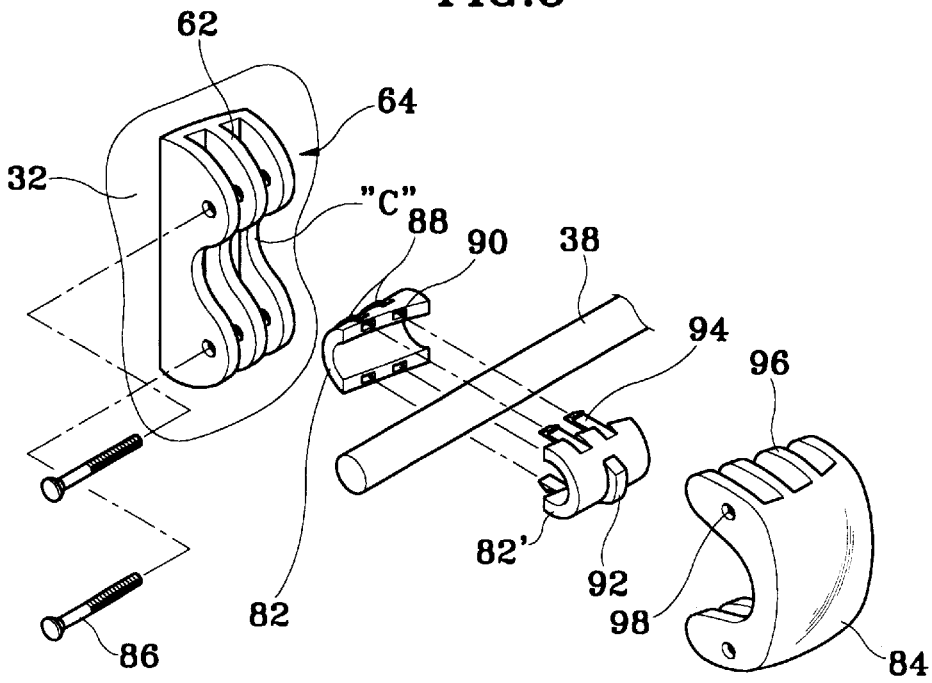
FIG. 5 is a perspective, exploded view illustrating in detail a coupling part of the back support and frame shown in FIG. 1.

FIG. 5 is a perspective, exploded view illustrating a coupling part of the back support and frame of the present invention as seen from behind the back support.

As shown in FIG. 5, the flange units 64, having a plurality of flanges 62 formed at the external surface of the back support 32, are shaped with a ridge at two sides thereof and a valley at the center thereof. In the preferred embodiment of the present invention, there are three flanges 62 in each flange unit 64.

A pair of bushes 82 and 82' are detachably inserted at the valley of the flange units 64, while the back support part 38 of the frame fits between the bushes 82 and 82'. The third coupling unit 84 is fixed at the flange units 64 with fastening members 86, while surrounding the bushes 82 and 82'.

A protruding part 88 is formed at the external surface of the bush 82 to be inserted at spacing C between the flanges 62. A connecting hole 90 is formed at the one side of the bush 82 to hold a connecting protrusion 94 which will be described below. Furthermore, a protrusion 92 is formed at the external surface of the bush 82' to be connected to a groove (not shown here) in the second coupling unit 84. The connecting protrusion 94 is formed at the one side of the bush 82' to be connected into the connecting hole 90 of the bush 82. In addition, the aforementioned bushes 82 and 82' are molded from acetaldehyde injection molds.

The third coupling unit 84 is shaped like a halfmoon as seen from its lateral side, including a plurality of meshing projections 96 formed at both sides thereof to mesh with the ridge of the flange units 64 and a fastening hole 98 to which the fastening members 86 are fastened.

Figure 6:
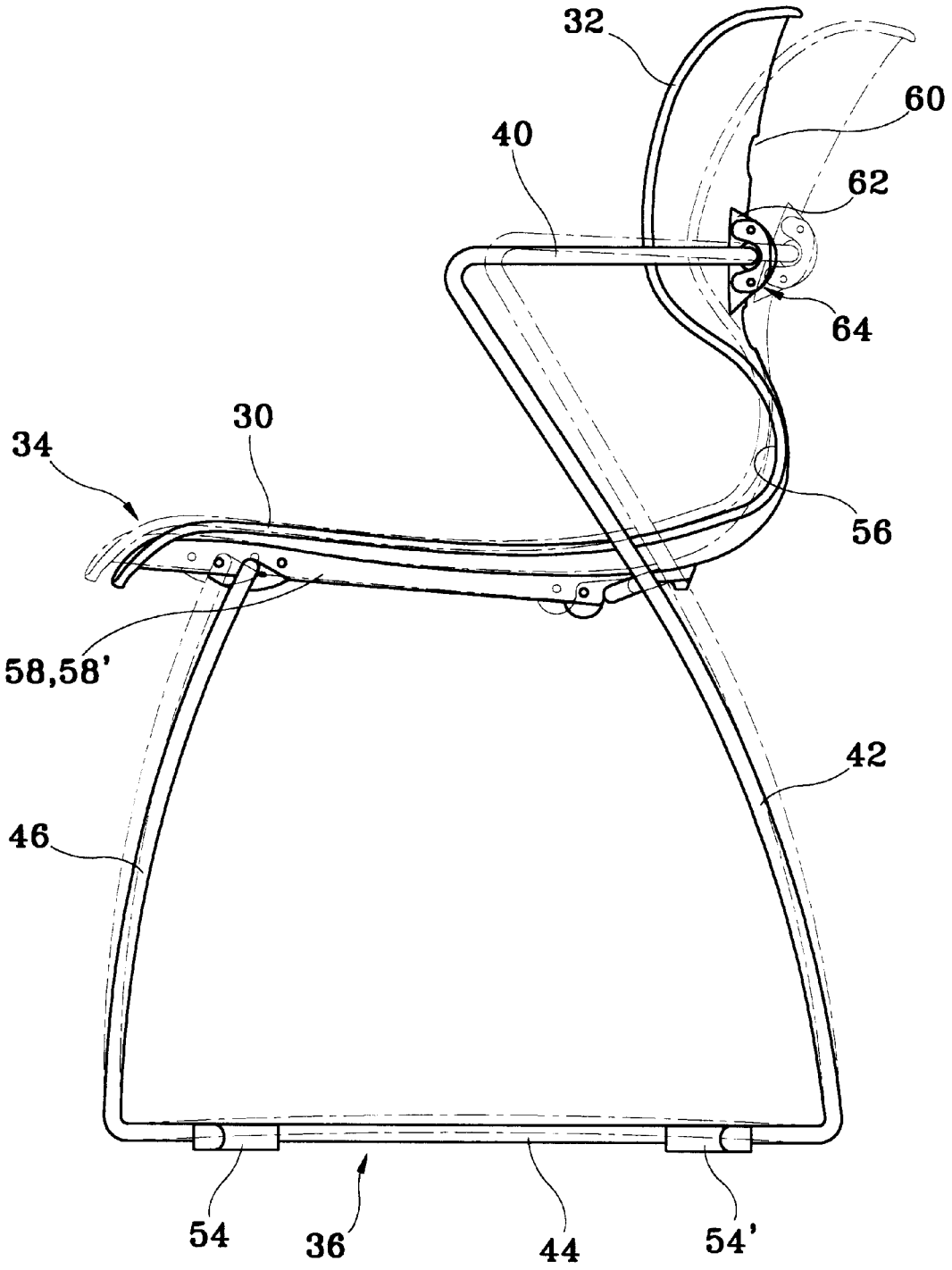
FIG. 6 illustrates tilting states of a tilting chair in accordance with the first embodiment of the present invention.

As shown with the tilting chair in accordance with the first embodiment of the present invention, if a user leans onto the back support 32 to put pressure thereon, the shape of the chair changes from a solid line state to the dot line test state, as shown in FIG. 6.

In other words, as the back support 32 is tilted backwards, the front leg 46 and rear leg 42 are pushed apart in the opposite directions from both ends of the feet 44 of the frame 36. Elasticity of the frame 36 and of the support board 34 provides tilting strength, and the back support 32 maintains it's a curved shape. As a result, a user feels comfortable without any pressure on the user's back even when the chair is tilted.

When the chair is tilted, the rear side seat support part 50 slides along the external surface of the tail part 81 of the second coupling unit 74 to support the back side of the seat 30 and the user's weight. Also, the frictional force, that is generated when the seat rear side support part 50 slides, controls the tilting strength because it increases or decreases depending upon the user's weight. If the rear side seat support part 50 slides at a predetermined angle, it is connected by the connecting protrusion 83, thereby restricting the tilting range.

Therefore, the seat rear side support part and the second coupling unit prevent the back support from excessively tilting backwards by restricting the tilting range. At this time, the back support part 38 is pivoted against the back support 32.

In addition, a constant level of friction remains between the rear side seat support part 55 and the second coupling unit 74, so that a level of strength is not required to maintain a desired tilting angle. The back support part 38 is pivoted against the back support 32 when the chair is tilted. At this time, the back support part 38 is shaped in a curve. A pair of the acetaldehyde bushes 82 and 82' partially provide a linear movement range around the same axle to thereby prevent friction and abrasion of the pivot.

Furthermore, connecting protrusions of another chair are inserted into the connecting protrusions 69 and 69' of the shoes 54 and 54' which fit onto the feet 44 and 44' for an easy alignment.

Figure 7:
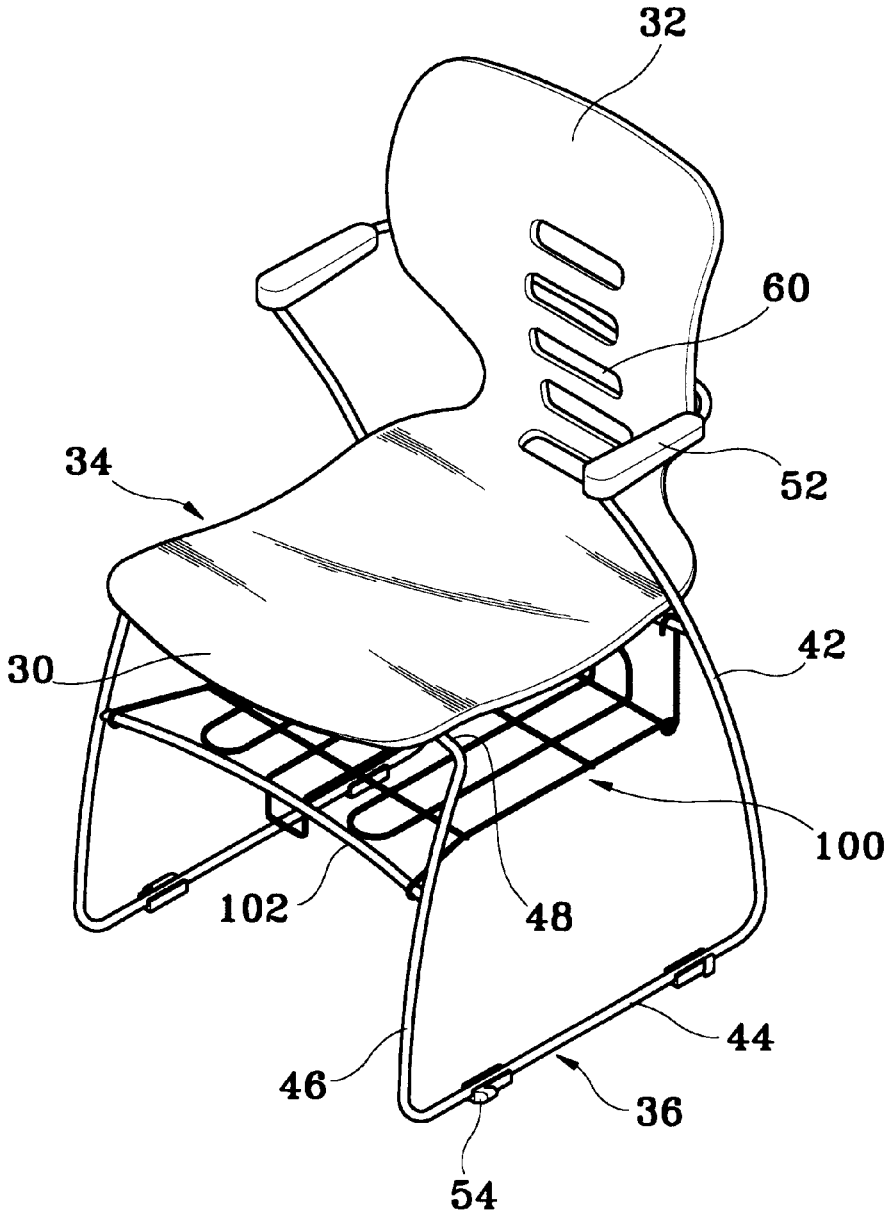
FIG. 7 is a perspective view illustrating a tilting chair in accordance with a second embodiment of the present invention.
Figure 8:
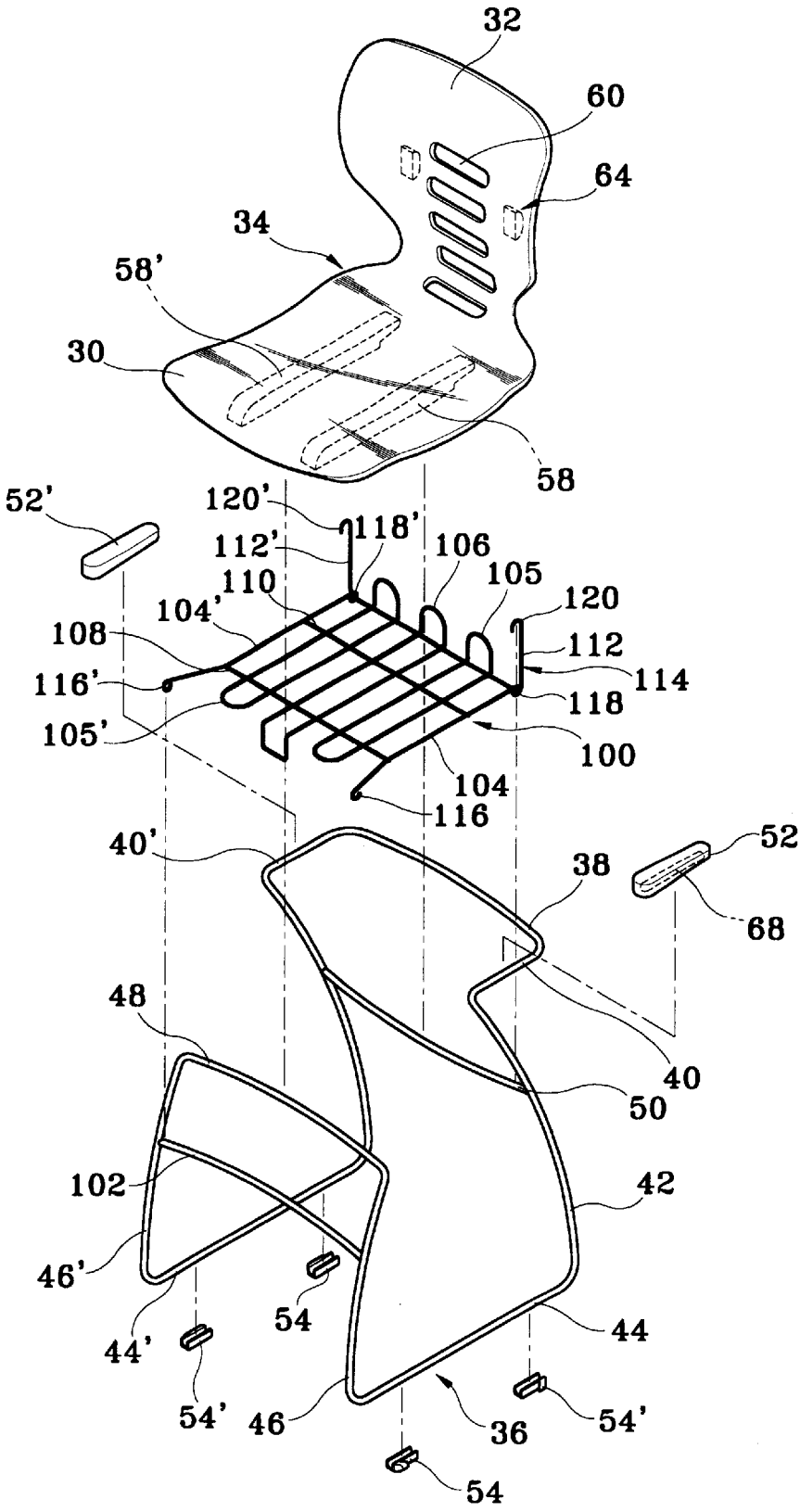
FIG. 8 is an exploded view of a tilting chair in accordance with the second embodiment of the present invention.

FIGS. 7 and 8 are respectively a perspective view and an exploded, perspective view for illustrating a stackable, tilting chair in accordance with a second embodiment of the present invention.

As shown in the drawings, in the second embodiment of the present invention, a shelf 100 is mounted under the seat 30 of the first embodiment of the present invention to conveniently place a user's belongings.

In other words, a front horizontal part 102 extends in parallel to the seat front side support part 48 from the center of the front legs 46. The shelf 100 is coupled with its front portion being connected to the front horizontal part 102 and with its rear portion being connected to the seat rear side support part 50.

The front horizontal part 102 is bent to the rear in a curved shape.

In the shelf 100, lengthwise rods 105, 105' and 106 are in the shape of a long, thin steel curve and are aligned at a predetermined spacing between horizontal connecting racks 104 and 104' which hold onto the horizontal part 102. The lengthwise rods 105, 105' and 106 are connected together by horizontal rod 108. Rear connecting racks 114 are constructed with center part 110 in parallel to the horizontal rod 108 at the rear end of the horizontal hitching racks 104 and 104', and vertical parts 112and 112' vertically extend and are bent at both ends of the center part 110.

At this time, the horizontal connecting racks 104 and 104' extend at their front side to prevent any horizontal movement of the shelf. Front loops 116 and 116' are formed at the ends of the horizontal connecting racks 104 and 104' to be connected to both ends of the front horizontal part 102. The rear loops 118 and 118' are formed at the rear ends of the horizontal connecting racks 104 and 104', and the bent parts of the rear connecting racks 114 are shaped to be rotated and coupled with the rear loops 118 and 118'.

The rear end of the lengthwise rods 105 and 105' is bent upwards. The front end of the vertical rod 106 is bent downwards to prevent easy detachment, after being assembled, even when the chair is tilted. At this time, the downwardly bent front end of the lengthwise rod 106 is connected to the front horizontal part 102.

Loops 120 and 120' are formed at the end of the rear connecting racks 114 to be connected to both sides of the seat rear side support part 50.

Figure 9:
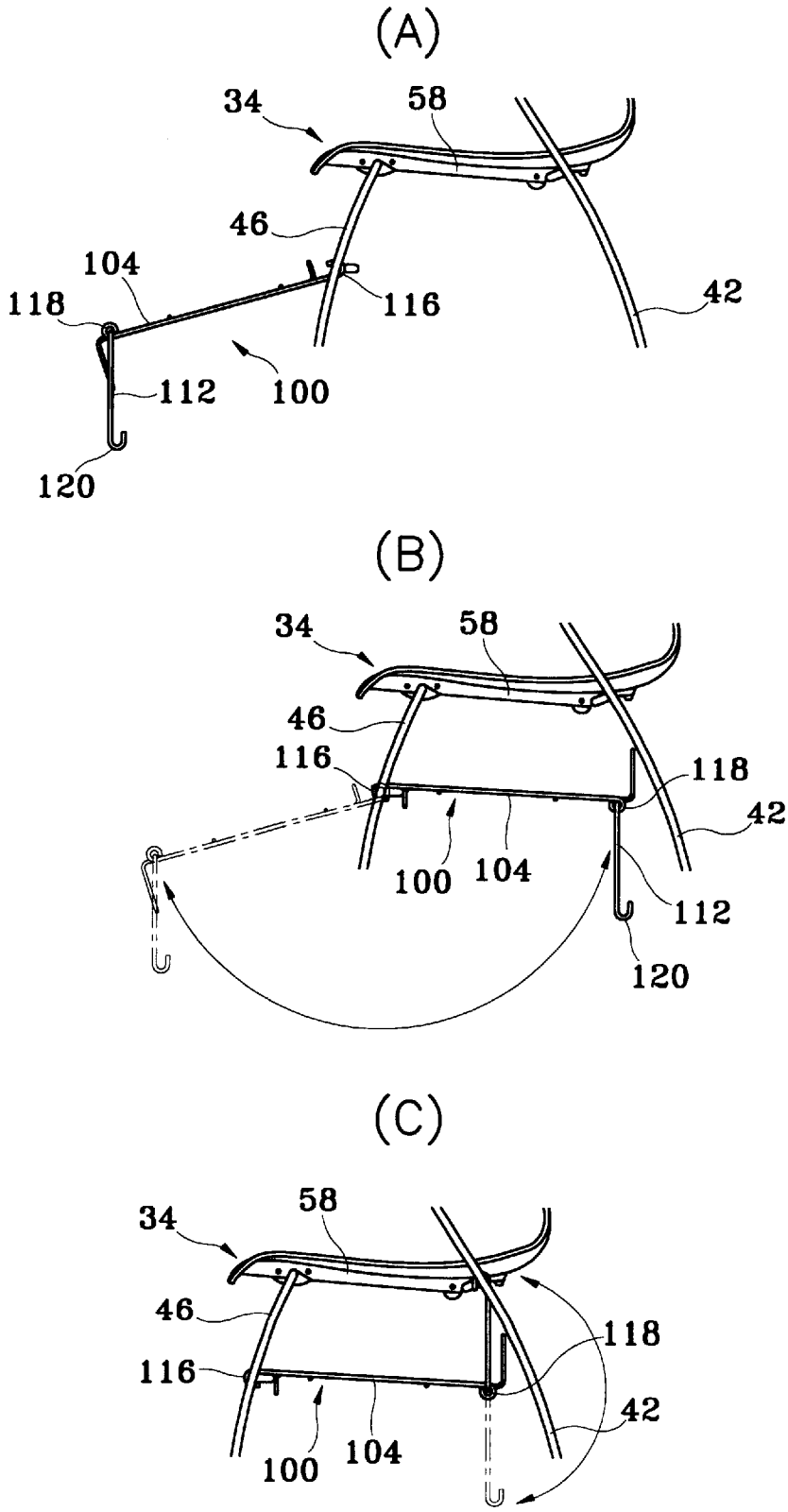
FIG. 9 is a sequential view for illustrating assembling steps of a shelf onto the second embodiment of the invention of FIG. 7.

The shelf 100, as shown in FIG. 9, is completely assembled by holding the front loops 116 and 116' of the horizontal hitching racks 104 and 104' at both ends of the front horizontal part 102, pulling the rear connecting racks 114 toward the rear legs 42 and 42', turning the vertical parts 112 and 112' of the rear connecting rack 114 upwards in the counter-clock direction and connecting the loop 120 and 120' to both ends of the seat rear side support part 50.

As described above, the shelf 100 is useful for conveniently holding a variety of a user's belongings, and, after complete assembly, the shelf is strong enough to avoid any structural problem at its fixed parts when the chair is tilted.

Figure 10:
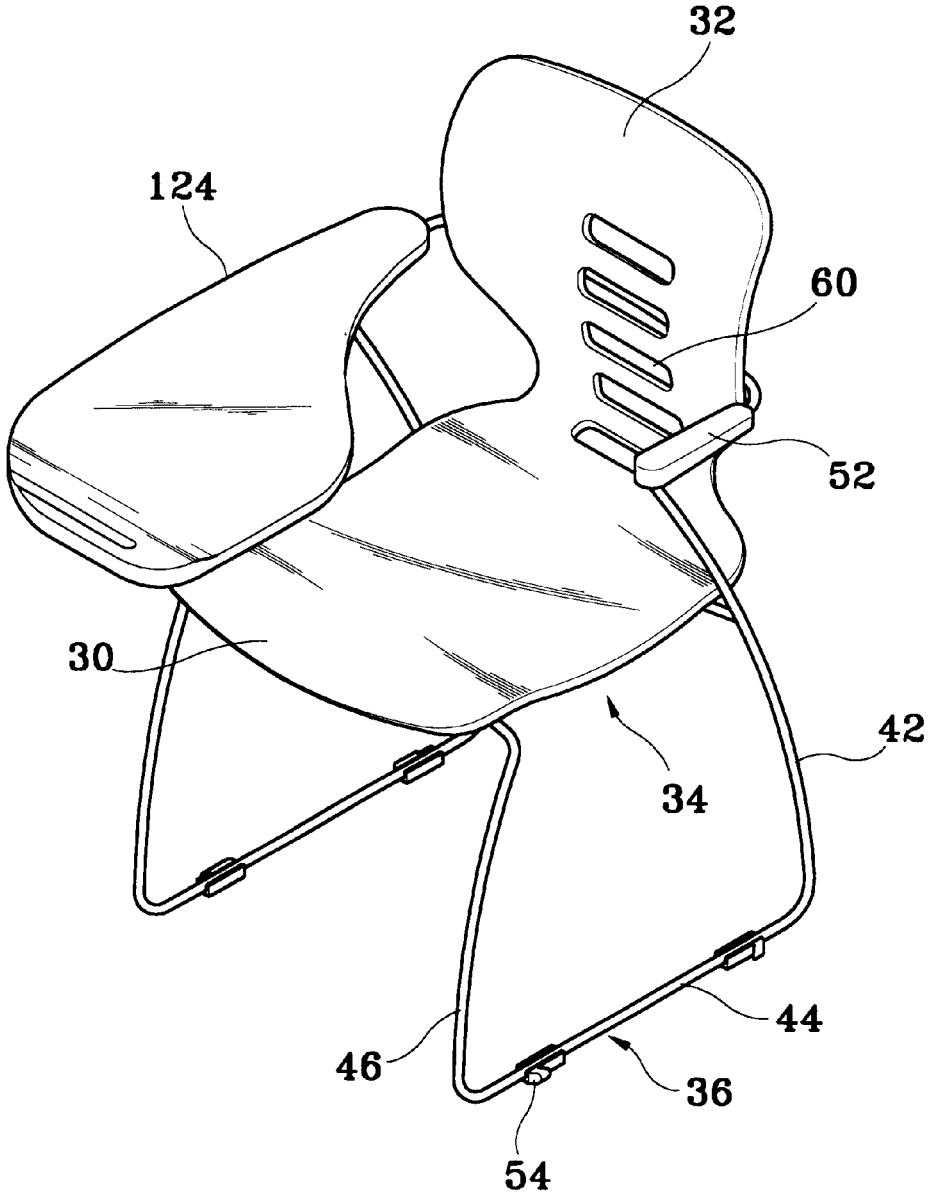
FIG. 10 is a perspective view illustrating a tilting chair in accordance with a third embodiment of the present invention.
Figure 11:
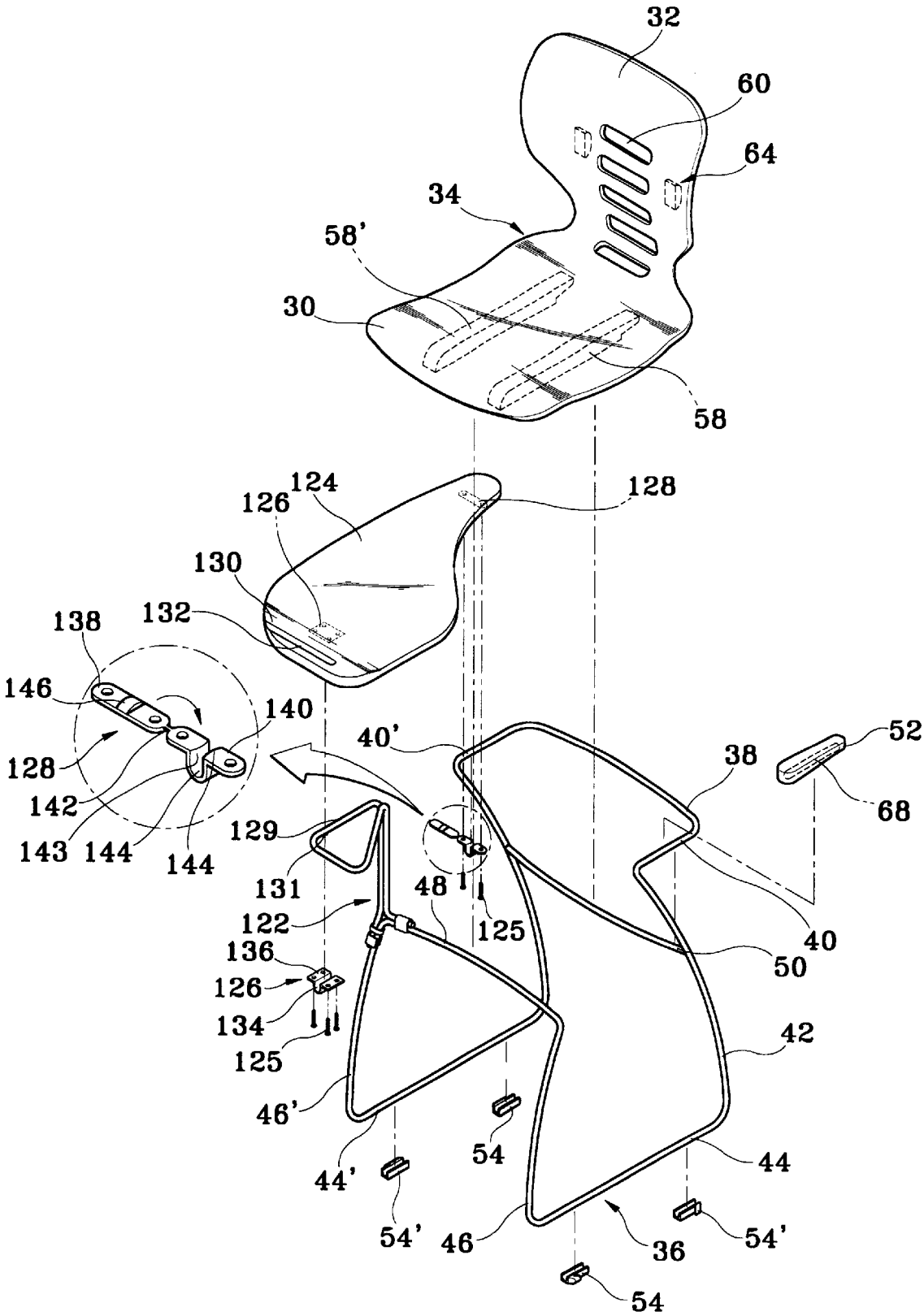
FIG. 11 is an exploded perspective view for illustrating a tilting chair in accordance with the third embodiment of the present invention.
Figure 12:
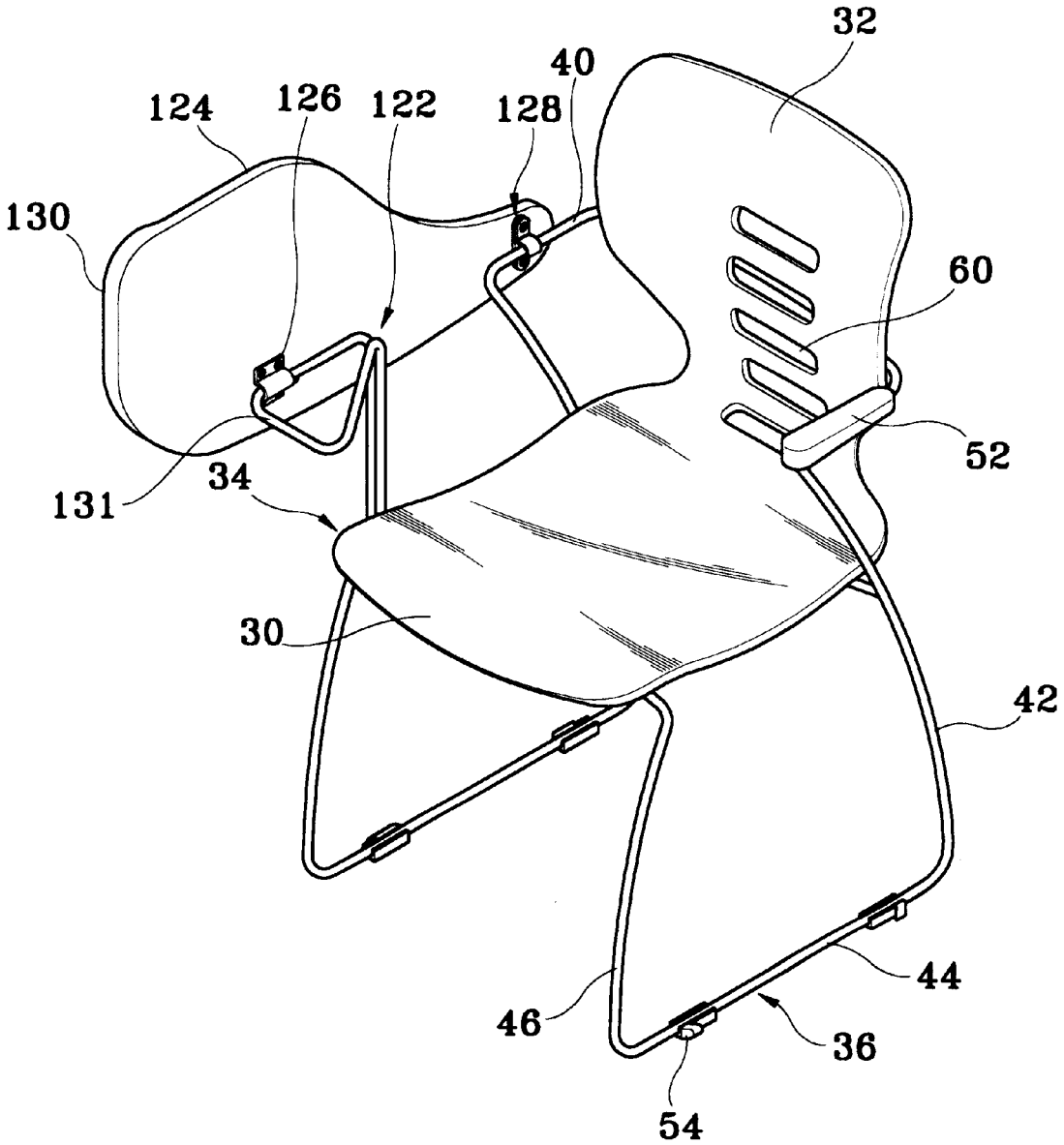
FIG. 12 illustrates a tilting chair including a writing board positioned in a folded up position in accordance with the third embodiment of the present invention.

FIGS. 10 through 12 are exploded, perspective views for illustrating a stackable tilting chair in accordance with a third embodiment of the present invention.

As shown in the drawings, in the third embodiment of the present invention, a support rack 122 extends upwards to the height of the horizontally extended part 40' at a part where the seat front side support part 48 and the front leg 46' meet. A writing board 124 is coupled between the horizontally extended part 40' and the support rack 122. The user can conveniently take notes with the writing board 124. First and second fixing brackets 126 and 128 are connected to the horizontally extended part 40' and the support rack 122 with a fastening member 125.

At this time, the support rack 122 of a rod is fixed at the upper part of the front leg 46', extends upwards and is horizontally bent to form a triangular shape, extends downwards and, finally, is bent and fixed at the front side seat support part 48. In addition, a protrusion 131 is formed at the straight line part 129 of the triangular shape of the support rack 122 to prevent any relative movement between the writing board 124 and the support rack 122, and the first fixing bracket 126 is restrained at the corner of the triangle of the support rack 122.

The writing board 124 has a straight external portion and an inner portion shaped like a table tennis racket. The first and second fixing brackets 126 and 128 are coupled at the straight external portion. Furthermore, a protrusion 130 is formed at the front, upper surface of the writing board. A single line groove 132 is formed widthwise at the protrusion 130 along the writing board for accommodating a writing instrument such as a ball point pen.

A journal part 134 is formed in the middle of the first fixing bracket 126 for a contact with the straight line part 129 of the support rack, and a pair of flanges 136 and 136' are also included with through holes at both sides of the first fixing bracket 126.

The second fixing bracket 128 is formed to be foldable because it's a cover 138 and body 140 thereof are connected by a connecting part 142. Therefore, the horizontally extended part 40' is accommodated at the journal part 143 of the body 140 and the cover 138 is rotated to cover the horizontal part 40'. Then, the second fixing bracket 128 is fixed at the bottom surface of the writing board 124 with a fixing member 125. At this time, the arm support is not present at the horizontally extended part 40' where the second fixing bracket 128 is coupled.

At this time, a convex part 144 is formed at the journal part 143 for relatively convenient sliding relative to the horizontally extended part 40', and reinforcing ribs can be mounted at the external surface of the body 140. The convex part 146 is formed to touch the horizontally extended part 40' when the cover is placed.

As described above, the first and second fixing brackets 126 and 128 are a loosely coupled to the support rack 122 and the horizontally extended part 40'. As shown in FIG. 12, the writing board 124 can be folded outwards. The structure as such makes a user stand up and sit down comfortably.

Figure 13:
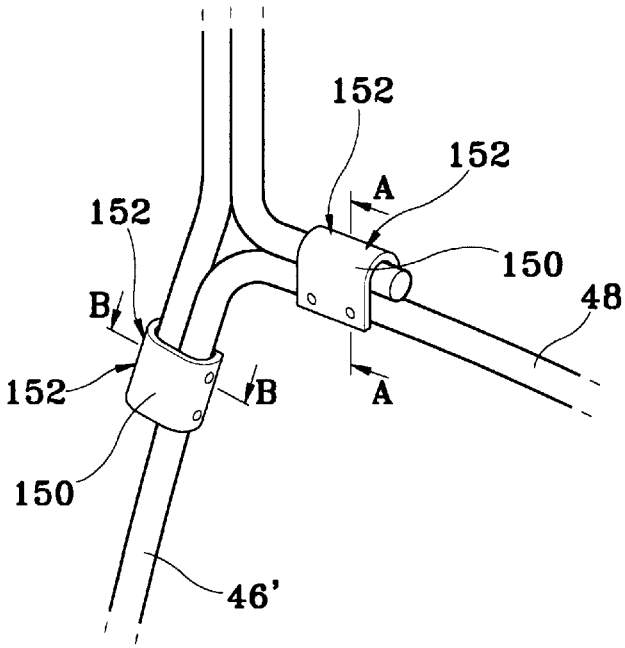
FIG. 13 illustrates a coupling state of the support rack shown in FIG. 11.
Figure 14:
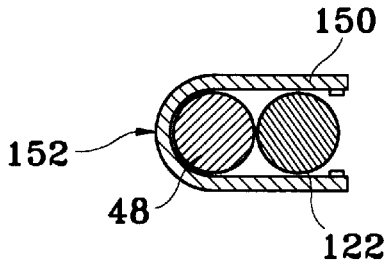
FIG. 14 is a cross-sectional view cut along arrow-marked line A—A shown in FIG. 13.
Figure 15:
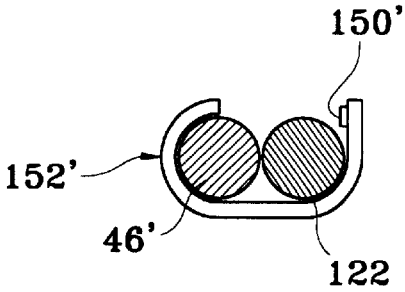
FIG. 15 is a cross-sectional view cut along arrow-marked line B—B show in FIG. 13.

Besides, as shown in FIGS. 13 through 15, U- or G-shaped clamps 152 and 152' are welded at the lower part of the support rack 122, and convex protrusions 150 and 150' are formed by punching to firmly fix the support rack at the front leg and the seat front side support part.

In accordance with the third embodiment of the present invention, a user can take notes with a pen on the writing board 124 while attending a lecture or a seminar without any influence of a tilted chair because the writing board is firmly fastened, even if there may be a slight movement of the back support and arm holders when the chair is tilted by the user. At this time, a writing instrument is conveniently accommodated in the groove 132 formed at the front portion of the writing board 124, so that the groove is useful for storing the writing instrument while the user stops taking notes and for using it again later.

Figure 16:
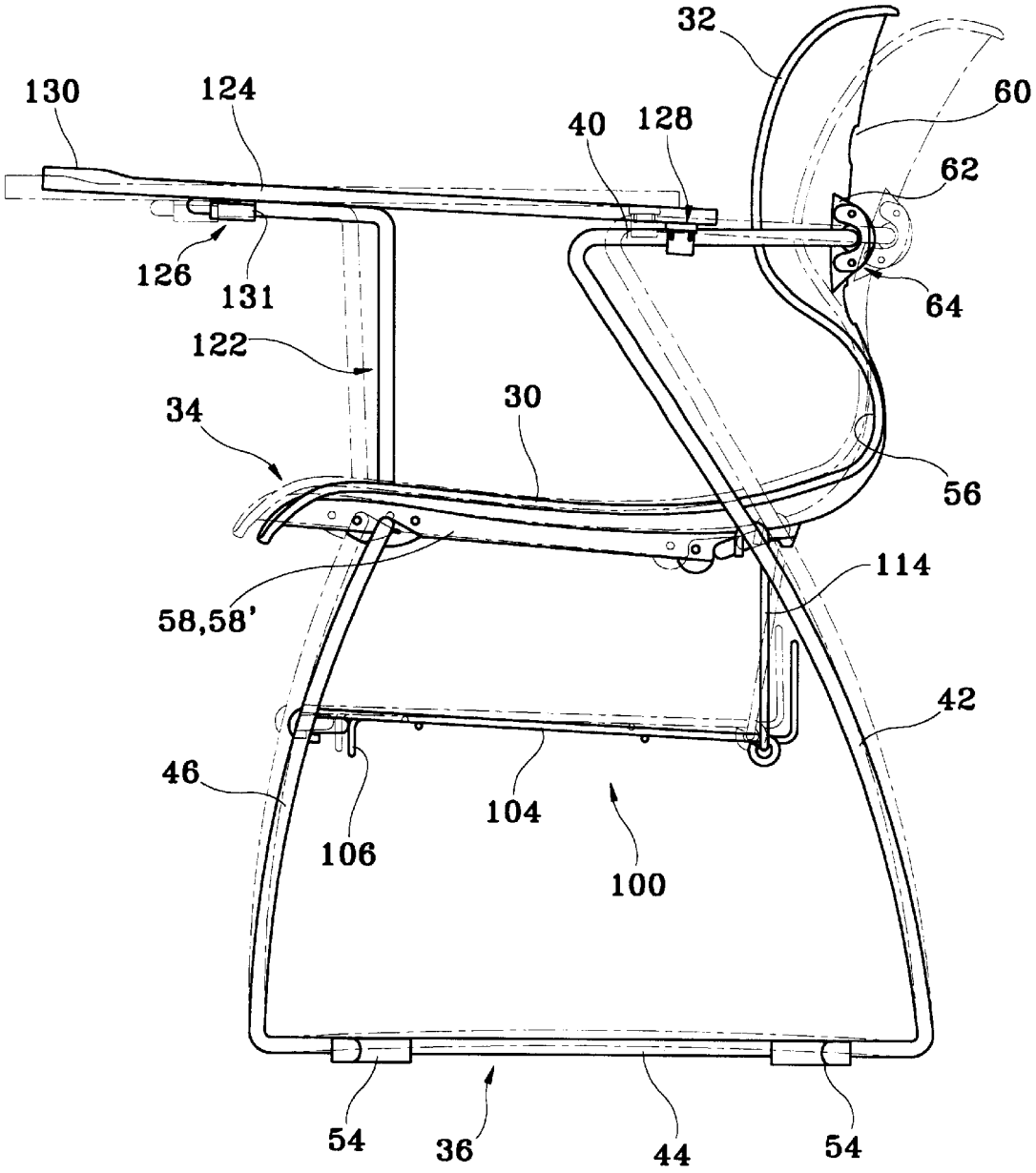
FIG. 16 illustrates a tilting state of a tilting chair with its shelf and writing board coupled altogether.

FIG. 16 illustrates an elevation view of a tilting chair with its shelf and writing board coupled altogether when the chair is tilted.

As shown in the drawing, if a user exerts pressure onto the back support 32 of the support board 34, the chair changes from the shape indicated by a solid line to the shape indicated by a dotted line, while maintaining a tilted state.

At this time, the first fixing bracket 126 prevents movement relative to the straight part 129 of the support rack 122 with the protrusion 131, but the second fixing bracket 128 moves relatively to the horizontally extended part 40' to provide an easy tilting function of the chair.

Furthermore, the rear connecting rack 114 of the shelf is freely rotated at the rear loop 118 of the horizontal rack 104, so that the shelf may change shape depending on the tilting of the chair, which makes the tilting of the chair easier. The front part of the vertical rod 106 is restrained by the middle part of the front horizontal part 102, thereby effectively preventing detachment of the shelf.

As described above, there are advantages in the tilting chair of the present invention in that a user feels comfortable without any pressure being placed onto the user's back when stretching the body backwards because the chair is tilted. The chair has a function of being easy to control it's the tilting force and range depending upon a user and in that the chair can maintain its tilted angle with even a small degree of effort.

Moreover, the tilting chair of the present invention has another advantage in performing the tilting function without any influence from the shelf, on which a user may place materials, and a writing board, on which the user may take notes.

What is claimed is:

1. A tilting chair comprising:

a support board including an integrated seat and a back support which may be elastically transformed backwards when pressure is applied to the back support;

a frame comprising a back support part, horizontally coupled to an external surface of the back support, a pair of rear legs bent downwards and extending from left and right sides of the back support, a pair of feet bent at ends of the rear legs and extending forwardly, a pair of front legs extending upwardly from front ends of the feet, a bent front side seat support part which extends to upper ends of the front legs to support a front portion of the seat, and a rear side seat support part connected to a center portion of the rear legs to support a rear portion of the seat;

flanges longitudinally coupled at a bottom surface of the seat;

a first coupling unit, mounted at a front side of the flanges, which fixes the front side seat support part; and a second coupling unit, mounted at a rear side of the flanges, which fixes the rear side seat support part; and wherein the second coupling unit comprises a head part, a tail part and a connecting protrusion formed at an end of the tail part which allows the rear side seat support part to slide along the tail part within a range between the head part and the connecting protrusion.

2. A chair, as defined in claim 1, comprising:

a flange unit mounted on an external surface of the back support and formed with a plurality of spaced apart flanges positioned with a predetermined spacing from each other;

a pair of bushes fitting with the flange unit and releasably coupled to each other to permit insertion of the back support part therebetween; and a third coupling unit comprising a plurality of extensions which fit between the flanges of the flange unit.

3. A chair, as defined in claim 1, wherein:

the back support comprises a plurality of elongated holes permitting a user to lift the chair;

a concave part is formed at a portion where the seat and back support meet and are grooved to horizontally face each other to allow the back support to transform when pressure is applied to the back support; and a front end of the seat of the support board is formed with a downwardly curved surface to prevent a front end of the seat from pressing onto a user's thigh.

4. A chair, as defined in claim 2, wherein:

the back support comprises a plurality of elongated holes permitting a user to lift the chair;

a concave part is formed at a portion where the seat and back support meet and are grooved to horizontally face each other to allow the back support to transform when pressure is applied to the back support; and a front end of the seat of the support board is formed with a downwardly curved surface to prevent a front end of the seat from pressing onto a user's thigh.

5. A chair, as defined in claim 1, wherein:

pairs of shoes are respectively coupled to the feet with connecting protrusions formed to face each other for connection to another chair.

6. A chair, as defined in claim 2, wherein:

pairs of shoes are respectively coupled to the feet with connecting protrusions formed to face each other for connection to another chair.

7. A chair, as defined in claim 1, comprising:

a front horizontal part extending from a center portion of the front legs in parallel to the front side seat support part; and a shelf, with a front portion connected to a front horizontal part of the frame and a rear portion connected to the rear side seat support; and wherein the shelf comprises a horizontal rack connected to the front horizontal part and a vertical part rotatively coupled to the horizontal rack at the rear portion and connected to the rear side seat support part.

8. A chair, as defined in claim 2, comprising:

a front horizontal part extending from a center portion of the front legs in parallel to the front side seat support part; and a shelf, with a front portion connected to a front horizontal part of the frame and a rear portion connected to the rear side seat support; and wherein the shelf comprises a horizontal rack connected to the front horizontal part and a vertical part rotatively coupled to the horizontal rack at the rear portion and connected to the rear side seat support part.

9. A chair, as defined in claim 1, wherein:

a pair of horizontally extending parts extend in parallel to the seat at both left and right ends of the back support;

the pair of rear legs are bent toward the floor from an end of the horizontally extending parts;

a support rack is coupled at a part where the front side seat support and the front leg meet and extends upwardly to a height of the horizontally extending part;

a board is coupled at the horizontally extending parts and at the support rack for providing a writing surface;

an upper portion of the support rack is coupled with the board by a first fixing bracket;

the horizontally extended parts are coupled with the board by a second fixing bracket;

the first fixing bracket is restricted to a relative movement with the support rack by a protrusion formed at the support rack when the chair is tilted; and the second fixing bracket is coupled to slide relative to the horizontally extended part when the chair is tilted.

10. A chair, as defined in claim 2, wherein:

a pair of horizontally extending parts extend in parallel to the seat at both left and right ends of the back support;

the pair of rear legs are bent toward the floor from an end of the horizontally extending parts;

a support rack is coupled at a part where the front side seat support and the front leg meet and extends upwardly to a height of the horizontally extending part;

a board is coupled at the horizontally extending parts and at the support rack for providing a writing surface;

an upper portion of the support rack is coupled with the board by a first fixing bracket;

the horizontally extended parts are coupled with the board by a second fixing bracket;

the first fixing bracket is restricted to a relative movement with the support rack by a protrusion formed at the support rack when the chair is tilted; and the second fixing bracket is coupled to slide relative to the horizontally extended part when the chair is tilted.

* * * * *